US005364300A

United States Patent [19]

Jow

[11] Patent Number: 5,364,300

[45] Date of Patent: Nov. 15, 1994

[54] TOY TRAIN

[76] Inventor: Jin-Long Jow, 2F., No. 56, Sec. 5, Nan Ching E. Rd., Taipei, Taiwan, Prov. of China

[21] Appl. No.: 16,274

[22] Filed: Feb. 11, 1993

[51] Int. Cl.[5] ..... A63H 17/00; A63H 17/267

[52] U.S. Cl. ..... 446/437; 446/462; 446/469

[58] Field of Search ..... 446/457, 437, 462, 466, 446/469, 470, 436, 447, 463

[56] References Cited

U.S. PATENT DOCUMENTS 4,457,099 7/1984 Kozuka et al. ..... 446/437
4,718,875 1/1988 McKittrick et al. ..... 446/469

*Primary Examiner*—Mickey Yu
*Attorney, Agent, or Firm*—Jacobson, Price, Holman & Stern

[57] ABSTRACT

A toy train is disclosed including a driving mechanism in a gear box, two driving wheels coupled to the driving mechanism, two driven mechanism coupled to the driving wheels through two transmission mechanisms and moved to turn linked wheel sets and driving gears, and two guide wheels driven by the driving mechanism, wherein turning on the gear box causes the driven mechanism to be swung outwards and inwards alternatively in moving the toy train or causing it to simulate the flying of a flying object.

6 Claims, 7 Drawing Sheets

TOY TRAIN

BACKGROUND OF THE INVENTION

1. Field of the Invention

The present invention relates to a toy train which comprises two driving wheels driven by a driving mechanism to swing two driven mechanisms inwards and outwards alternatively through two transmission mechanisms in moving the toy train or simulating the flying of a flying object.

2. Description of the Prior Art

A regular toy train according to the prior art is generally comprised of a body having a battery box on the bottom electrically connected to a motor inside the body, a transmission mechanism consisted of a series of gears coupled to the output shaft of the motor, two rows of wheels bilaterally disposed on two opposite sides of the body and coupled to respective shafts driven by the transmission mechanism, and a steering wheel turned to control the moving direction of the toy train. Because this structure of toy train gives little variety or change, it proves of little interest to children.

SUMMARY OF THE INVENTION

The present invention has been accomplished under the aforesaid circumstances.

According to one object of the present invention, the toy train comprises a driving mechanism consisted of a set of meshed gears received in a gear box inside a body thereof, two driving wheels coupled to the driving mechanism, two driven mechanism coupled to the driving wheels through two transmission mechanisms and moved to turn linked wheel sets and driving gears, and two guide wheels driven by the driving mechanism, wherein turning on the gear box causes the driven mechanism to be swung outwards and inwards alternatively in moving the toy train or causing it to simulate the flying of a flying object.

According to another object of the present invention, each driving wheel comprises a cam on an outer side, which has a groove around the border; each transmission mechanism comprises a reciprocating rod having one end coupled to the gear box and an opposite end terminated to a projecting member, which engages with the groove on the cam on either driving wheel.

According to still another object of the present invention, each driven mechanism comprises two pairs of pins respectively engaged with respective channels on the body and a hood at the front of the body for guiding the movement of the driven mechanism smoothly as they are alternatively lifted and lowered.

According to still another object of the present invention, each driven mechanism comprises a driving gear moved to mesh with a respective gear on the body driven by the driving mechanism through a respective guide wheel as each driven mechanism is lifted.

DETAILED DESCRIPTION OF THE PREFERRED EMBODIMENT

Figure 1:
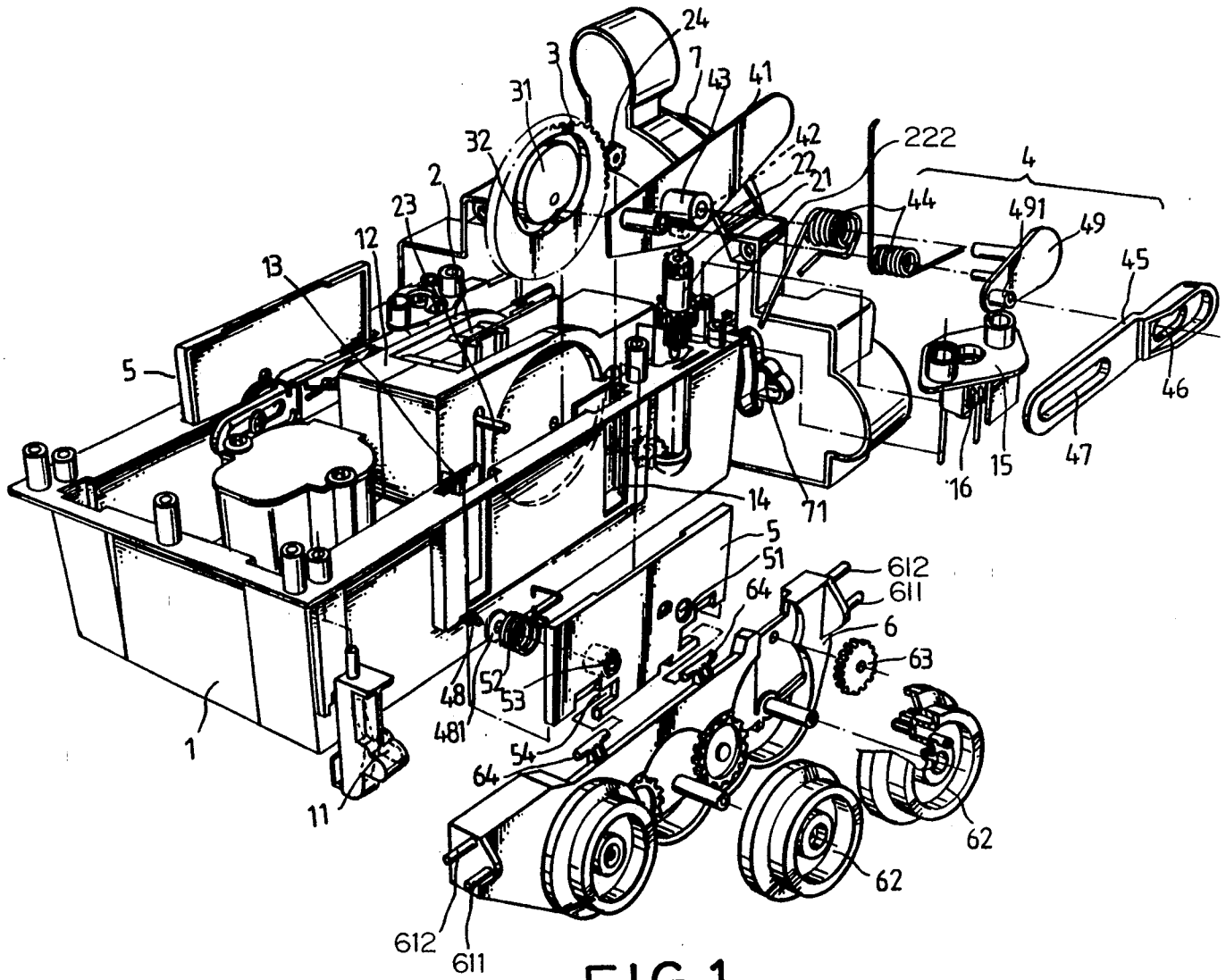
FIG. 1 is an exploded view of a toy train according to the present invention.

Referring to the annexed drawings, a toy train as constructed in accordance with the present invention is generally comprised of a body 1, a driving mechanism 2, two driving wheels 3, two transmission mechanisms 1, two slide plates 5, two driven mechanisms 6, and a hood 7.

Figure 2:
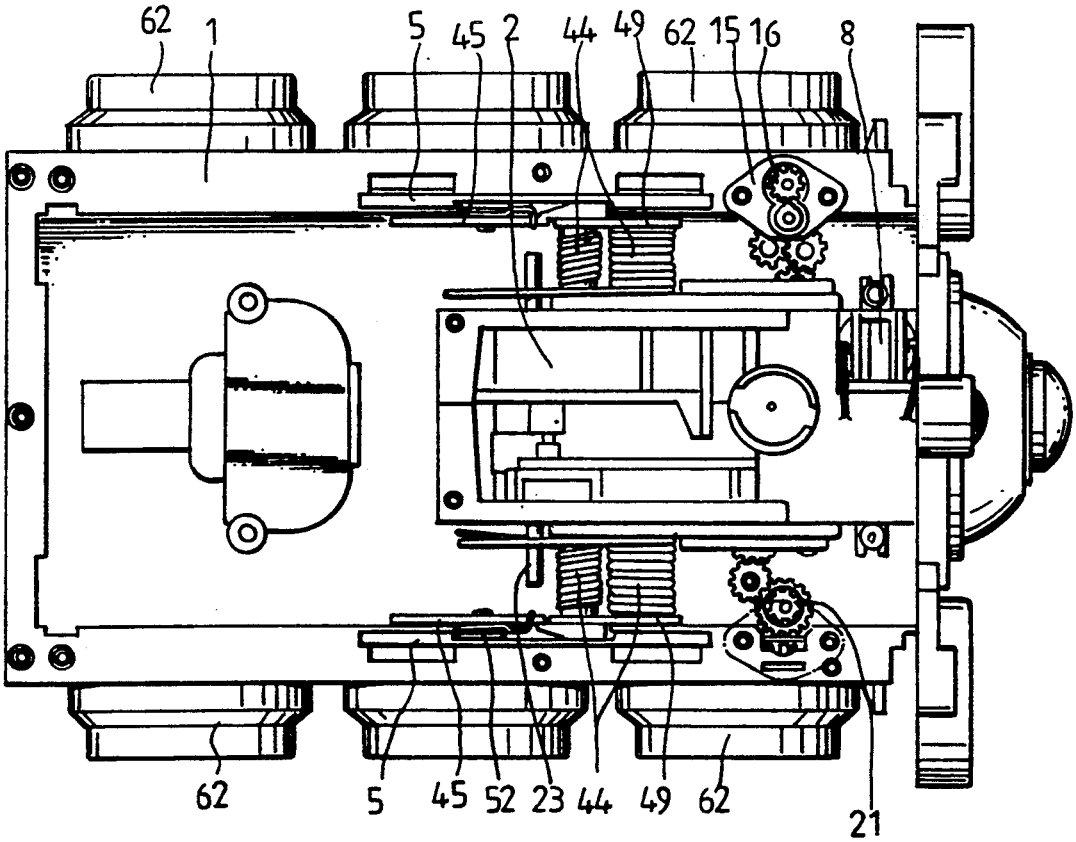
FIG. 2 is a top view thereof.
Figure 3:
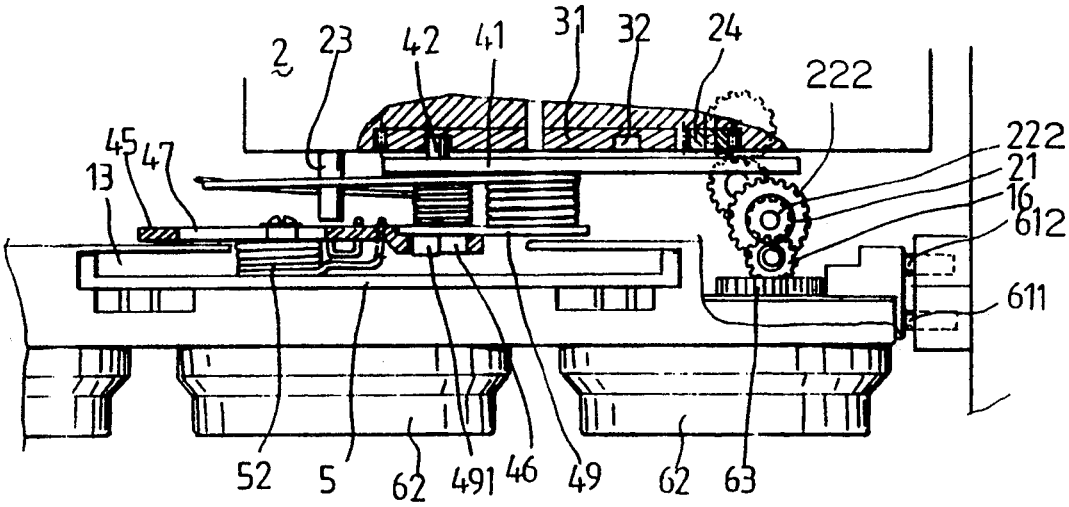
FIG. 3 is a lateral top view thereof.

Referring to FIGS. 1, 2 and 3, a hood 7 which is fastened to a body 1 at the front, has two channels 71 perpendicularly and symmetrically disposed at two opposite locations. The other end of body 1 comprises two symmetrical channels 11 bilaterally disposed at the back. The channels 11 are spaced from the hood 7 and their locations and shapes are corresponding to the channels 71, a gear box 12 on the inside in which a driving mechanism 2, which is consisted of a set of meshed gears (not shown), is received, a motor 8 coupled to the driving mechanism 2 and disposed outside the gear box 12. Two driving wheels 3 are bilaterally mounted on the gear box 12 and respectively coupled to the driving mechanism 2. There are two transmission mechanisms 4 respectively connected to the driving wheels 3. Two slide plates 5 are respectively coupled to the transmission mechanisms 4. Two driven mechanisms 6 are respectively connected to the slide plates 5 on the outside. Each driven mechanism 6 comprises two pairs of pins 611 and 612 longitudinally aligned at two opposite ends thereof and inserted in respective channels 71 or 11.

The driving mechanism 2 comprises two guide wheels 22 respectively coupled to two shafts 21 at two opposite sides thereof.

Each driving wheel 3 comprises a cam 31 on an outer side, which has a groove 32 around the border.

Each transmission mechanism 4 comprises a reciprocating rod 41 having a projecting member 42, which is engaged with the groove 32 on either driving wheel 3, and a stub tube 43, which is mounted with a spring 44 and carries a carrier 49. The carrier 49 comprises a pin 491 that inserted through a round hole 46 on one end of a connecting rod 45. The opposite end of the reciprocating rod 41 is coupled to the gear box 12.

Figure 7:
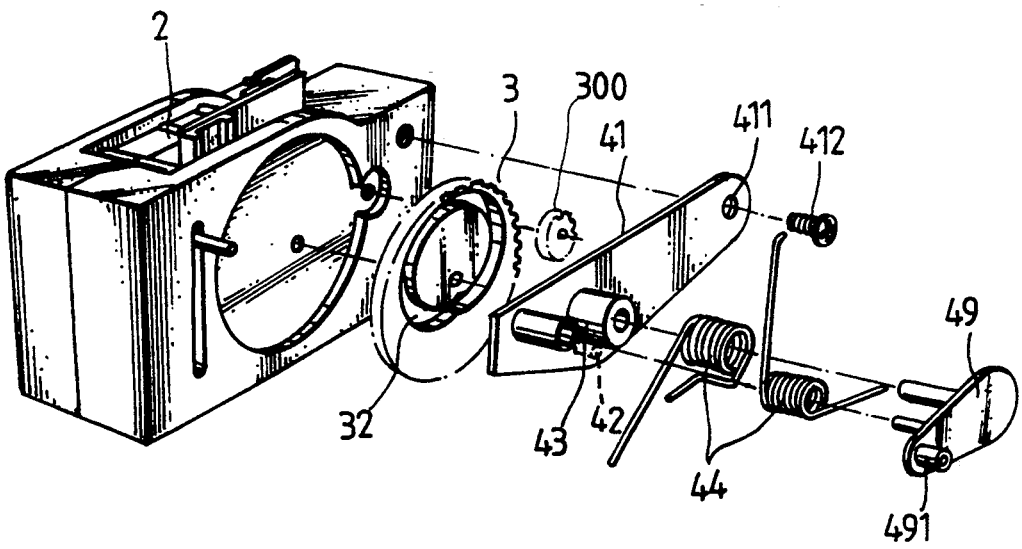
FIGS. 7 and 8 are perspective views of the driving mechanism with a driving wheel and transmission mechanism shown.
Figure 8:
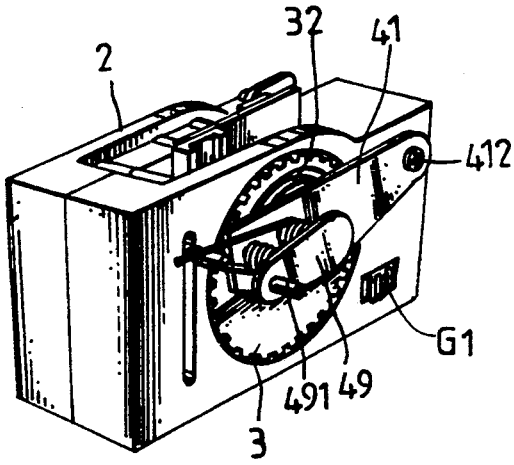

As shown in FIGS. 7 and 8, the reciprocating rod 41 includes a pivot hole 411 at one end, through which a pivot 412 is inserted and fitted into a hole on the shell of the driving mechanism 2. The projecting member 42, which is oppositely located on the reciprocating rod 41 with respect to the pivot hole 411, rides inside the groove 32 of the driving wheel 3. Accordingly, when the driving wheel 3 is rotated by gear 300, the projecting member 42 of the reciprocating rod 41 is reciprocated vertically by virtue of its movement through the groove 32.

Figure 5:
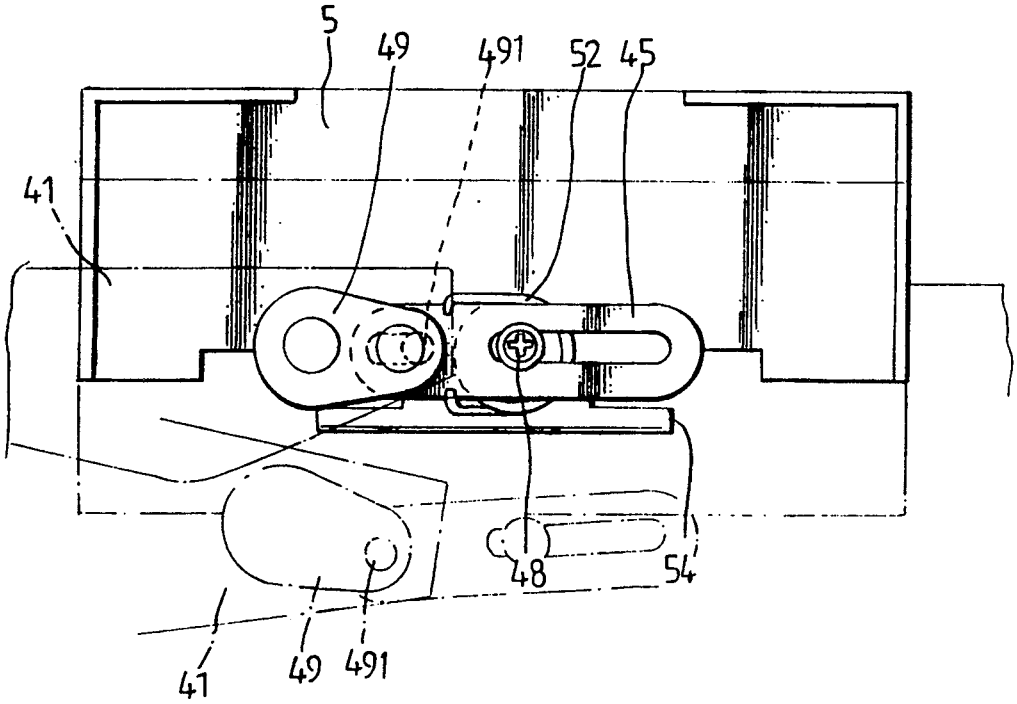
FIG. 5 illustrates the slide plate moved by the transmission mechanism.

Each slide plate 5 is disposed in a respective opening 13 on either side of the body 1, and includes a projecting ring 53 mounted with a spring 52 and coupled to the respective connecting rod 45. By threading a screw 48 through a washer 481 and an elongated slot 47 on the opposite end (relative to the hole 46) of the respective connecting rod 45 into the projecting ring 53, the respective connecting rod 45 is coupled to the respective slide plate 5. The round hole 46 disposed at an opposite end of the connecting rod 45, receives the pin 491 of the carrier 49 as shown in FIGS. 5 and 7. As a result, when the wheel 3 is turned, the carrier 49 is reciprocated vertically by the member 41, and this, in turn, causes the connecting rod 45 to urge the projecting ring 53 and its associated plate 5 upwardly or downwardly. Each slide plate 5 also comprises two spaced openings 54. The body 1 further comprises two caps 15 disposed at two opposite sides adjacent to either slide plate 5. Each cap 15 comprises a gear 16 on the inside meshed with the guide wheel 22 on either shaft 21 of the driving mechanism 2.

Figure 10:
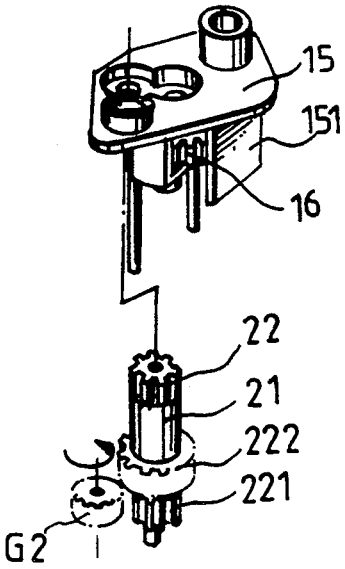
FIG. 10 is an exploded view of a cap and an associated guide wheel.

As shown in FIG. 10, the cap 15 is mounted on the shaft 21, and includes a gear 16 disposed inside. The shaft 21 comprises an upper gear 22 meshed with the gear 16 of the cap 15, and a lower gear 22 meshed with a reducing gear G2 which is meshed with gear G1 of the driving mechanism. As a result, the output power of the motor is transmitted through the lower and upper gears 22 of the shaft 21 to the gear 16 of the cap 15, causing the gear 16 to rotate.

Each driven mechanism 6 comprises two pivot pins 64 respectively engaged with two slots 14 on either side of the body 1 and then inserted in the two openings 54 on either slide plate 5. A linked wheel set 62 disposed on an outer side, two pairs of pins 611 and 612 longitudinally aligned at two opposite ends of the driven mechanism 6 and inserted in respective channels 71 of the hood 7 or channels 11 of the body 1, and a driving gear 63 meshed with the linked wheel set 62 and disposed at a location corresponding to the gear 16 of the respective cap 15.

Figure 4A:
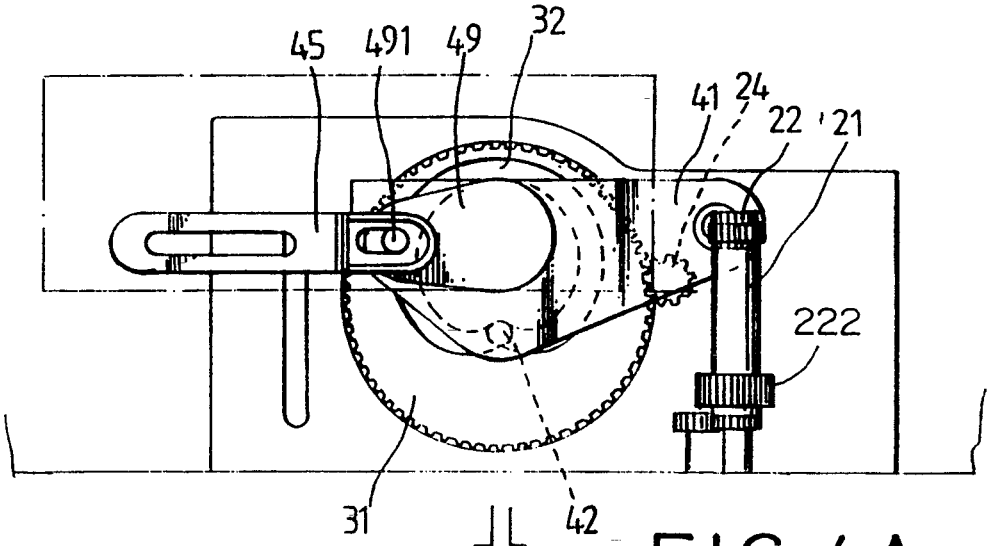
FIGS. 4A and 4B illustrates the transmission mechanism driven by the drive wheel.
Figure 4B:
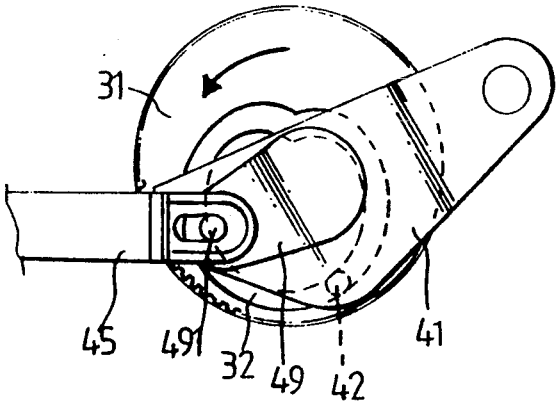
Figure 6:
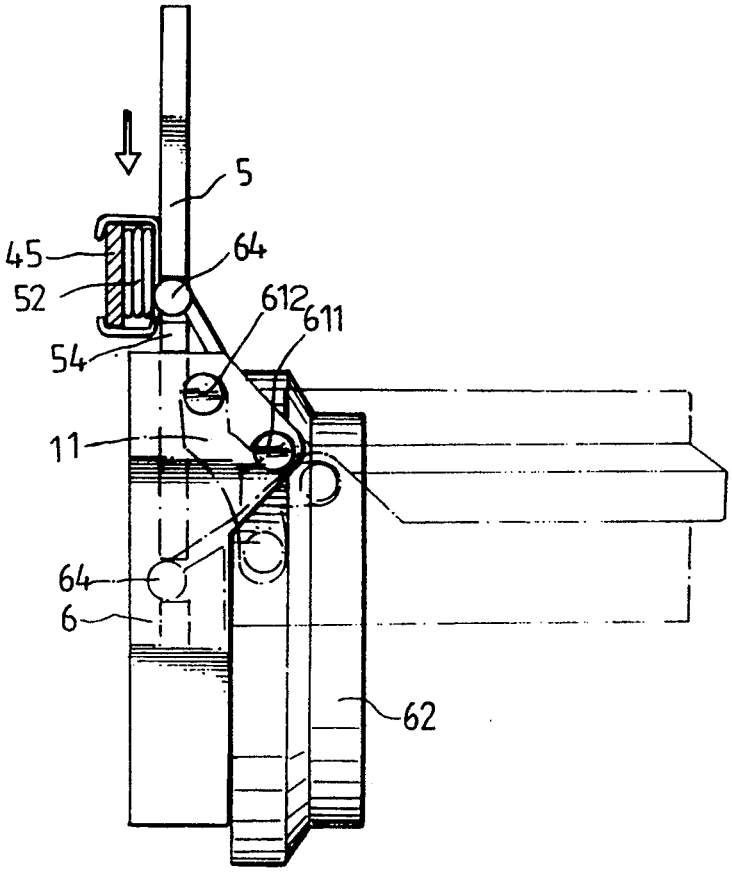
FIG. 6 illustrates the movement of the driven mechanism.

The operation of the toy train is outlined hereinafter with reference to FIGS. 4, 5, 6 and FIGS. 2 and 3 again. As the driving mechanism 2 is turned on to drive the driving wheels 3 and the guide wheels 22, each transmission mechanisms 4 is respectively caused to move along the groove 32 on the cam 31 of the respective driving wheel 3 in reciprocating the respective slide plate 5 via the respective reciprocating rod 41 and the respective carrier 49. The slide plates 5 move up and down to cause the driven mechanisms 6 to be swung outwards and inwards alternatively.

Figure 9:
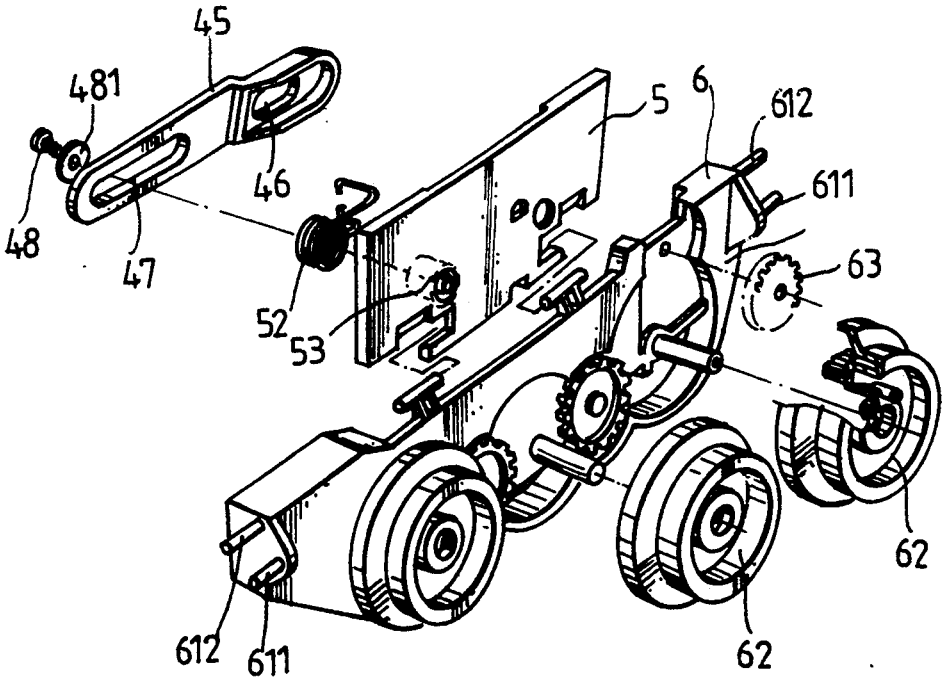
FIG. 9 is an exploded view of a driven mechanism.

As shown in FIG. 9, the driven mechanism 6 has two pins 611 and 612 disposed at each longitudinal end of the driven mechanism 6. The two opposite lower pins 611 are inserted into the axle holes 711 of the channels 11 and 71 at both sides of each driven mechanism 6, while the upper pins 612 are inserted into the elongated guide grooves 712. By using this arrangement, whenever the driven mechanism 6 is pushed upwards or downwards, it will be forced to turn about an axis defined through the axle holes 711, along the elongated guide grooves 712 and to move from the horizontal position to the vertical position or vice versa.

Figure 11:
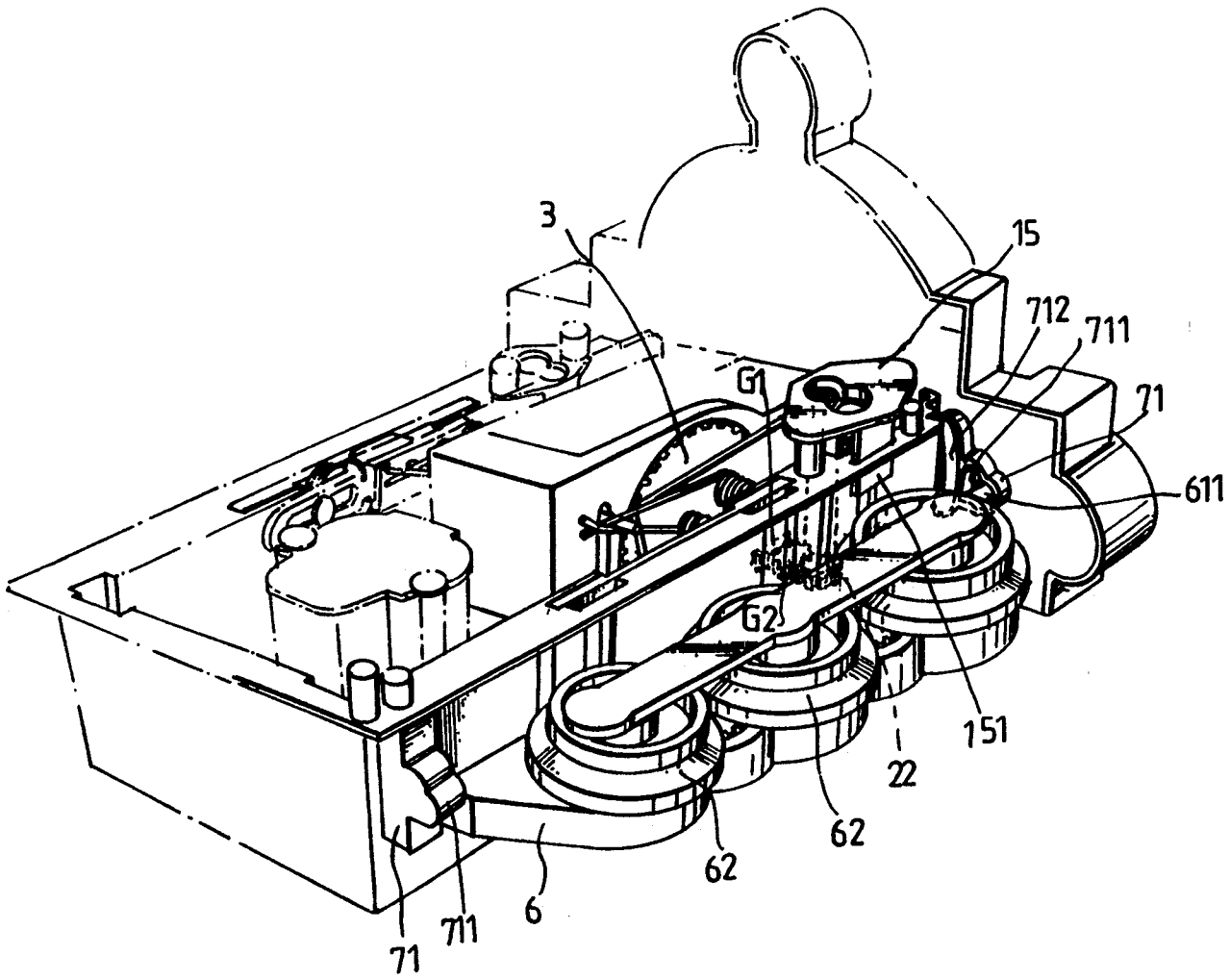
FIG. 11 is a perspective view of the toy train when the driven mechanism is positioned so as to simulate flight.

As shown in FIG. 11, because the driven mechanism 6 is movably connected to the slide plate 5, when the wheel 3 is turned to move the slide plate 5 to its upper limit, the gear 63 of the driven mechanism 6 will be moved up to mesh with the gear 16 and will be disposed between the extension board 151 and the gear 16. The wheel 62 of the driven mechanism 6 is thus driven via the shaft 21.

When the slide plate 5 is moved to the lower limit, the driven mechanism 6 is turned from the vertical position to the horizontal position causing the gear 63 to move to a lower elevation than the shaft 21 and then mesh with the gear 222. The wheel 62 of the driven mechanism 6 is therefore directly turned. Therefore, the alternative motion of the driven mechanism 6 makes the toy train to move on the ground, and simultaneously to simulate the flying of a flying object.

What is claimed is:

1. A toy train comprising:

a body;

a motor mounted on said body;

a driving mechanism having a gear box, said driving mechanism being mounted to said body and being coupled to said motor;

a first driving wheel coupled to said driving mechanism and disposed on a first lateral side of said driving mechanism;

a second driving wheel also coupled to said driving mechanism but disposed on an opposite lateral side of said driving mechanism;

a first transmission mechanism coupled to said first driving wheel;

a second transmission mechanism coupled to said second driving wheel;

a first slide plate slidably mounted to a first lateral side of said body and coupled to said first transmission;

a second slide plate slidably mounted to an opposite lateral side of said body and coupled to said second transmission;

a first driven mechanism movably disposed against said first lateral side of said body and connected to said first slide plate so as to move in response to sliding of said first slide plate;

a second driven mechanism movably disposed against said opposite lateral side of said body and connected to said second slide plate so as to move in response to sliding of said second slide plate;

a hood disposed at a forward longitudinal end of said body, said hood having a first channel disposed at the first lateral side of said body and a second channel disposed at said opposite lateral side of the body;

a first rear channel disposed at a rearward longitudinal end of said body and at the first lateral side of said body; and a second rear channel disposed at said rearward longitudinal end of said body but at the opposite lateral side of the body, said first and second rear channels being disposed symmetrically on said body with respect to said first channel and second channel of said hood, said first driven mechanism having a front pair of pins which engage the first channel of said hood, and a rear pair of pins which engage the first rear channel, thereby permitting the first driven mechanism to be moved from a substantially vertical orientation to a substantially horizontal orientation in response to sliding of said first slide plate;

said second driven mechanism having a front pair of pins which engage the second channel of said hood, and a rear pair of pins which engage the second rear channel, thereby permitting the second driven mechanism to be moved from a substantially vertical orientation to a substantially horizontal orientation in response to sliding of said second slide plate.

2. The toy train of claim 1, and further comprising two guide wheels connected to said drive mechanism, each guide wheel being coupled to a shaft and being disposed adjacent said hood.

3. The toy train of claim 1, wherein:

said first drive wheel includes a first groove formed on an outside surface of said first drive wheel, said first groove forming a closed loop so as to define a cam in said first drive wheel; and said second drive wheel includes a second groove formed on an outside surface of said second drive wheel, said second groove also forming a closed loop so as to define a cam in said second drive wheel.

4. The toy train of claim 3, wherein each of said first and second transmission mechanisms comprises:

a reciprocating rod having one end coupled to said gear box and an opposite end terminating in a projecting member, the projecting member of said first transmission mechanism being received in said groove of said first drive wheel, while the projecting member of said second transmission mechanism is received in said groove of said second drive wheel, each reciprocating rod further comprising a stub tube circumferentially surrounded by a coil spring;

a carrier mounted to said stub tube, said carrier comprising a pin member; and a connecting rod spanning a distance between said pin member of the carrier and a hole in one of said first and second slide plates.

5. The toy train of claim 4, wherein said body comprises a first cap disposed toward said first lateral side of said body, and a second cap disposed toward said opposite lateral side of said body, said first and second caps comprising an internal gear meshed with a guide wheel which, in turn, is connected to said drive mechanism; and wherein each of said first and second slide plates comprises:

a projecting ring circumferentially surrounded by a coil spring and coupled to an elongated slot formed in said connecting rod distally from said pin member; and two spaced openings.

6. A toy train according to claim 5, wherein each of said first and second driven mechanisms comprises:

pivot pins respectively passing through two slots defined on each lateral side of said body, and engaging said two spaced openings;

a laterally disposed set of linked wheels; and a driving gear meshed with said set of linked wheels and disposed at a location which facilitates meshing with the internal gear of one of said first and second end caps.

* * * * *